US007052376B1

(12) United States Patent
Kao et al.

(10) Patent No.: US 7,052,376 B1
(45) Date of Patent: May 30, 2006

(54) WAFER CARRIER GAP WASHER

(75) Inventors: Ming-Hsing Kao, Tai-Tung Hsien (TW); Ching-Wen Teng, Tao-Yuan Hsien (TW); Chin-Kun Lin, Kao-Hsiung (TW); Wee-Shiong Tan, Singapore (SG)

(73) Assignee: United Microelectronics Corp., Hsin-Chu (TW)

( * ) Notice: Subject to any disclaimer, the term of this patent is extended or adjusted under 35 U.S.C. 154(b) by 0 days.

(21) Appl. No.: 10/908,785

(22) Filed: May 26, 2005

(51) Int. Cl.
*B24B 7/00* (2006.01)

(52) U.S. Cl. ..... 451/65; 451/288; 451/444

(58) Field of Classification Search ..... 451/285–290, 451/60, 444, 446, 56, 65, 67, 388, 397, 398
See application file for complete search history.

(56) References Cited

U.S. PATENT DOCUMENTS 6,319,105 B1 * 11/2001 Togawa et al. ..... 451/287
6,325,698 B1 * 12/2001 Wada et al. ..... 451/8
6,334,810 B1 * 1/2002 Song et al. ..... 451/60
6,402,598 B1 * 6/2002 Ahn et al. ..... 451/65
6,443,826 B1 * 9/2002 Yang et al. ..... 451/388

* cited by examiner

*Primary Examiner*—Dung Van Nguyen
(74) *Attorney, Agent, or Firm*—Winston Hsu

(57) ABSTRACT

A wafer carrier gap washer includes at least one wafer carrier head and at least one nozzle installed on a wafer load/unload mechanism. The wafer carrier head has a flexible membrane and a retaining ring for holding a wafer beneath the wafer carrier head during a CMP process. The nozzle sprays fluid toward a gap between the flexible membrane and the retaining ring so as to wash the gap and remove slurry residues produced in the CMP process.

16 Claims, 2 Drawing Sheets

WAFER CARRIER GAP WASHER

BACKGROUND OF INVENTION

1. Field of the Invention

The present invention relates to a wafer carrier gap washer, and more particularly, to a gap washer for washing a wafer carrier head in a CMP apparatus.

2. Description of the Prior Art

The manufacturing of integrated circuits involves applying micro-circuit structures to form a set of whole devices, of which the method is highly precise and consists of multiple steps. With the trend of integrated circuit devices towards smaller size and larger integration, more process steps are necessary in order to achieve the multilevel structure on wafers. A multilevel metallization process is used extensively in the VLSI/ULSI process, whereby a plurality of metal interconnect layers and low dielectric constant materials are used to link each of the semiconductor devices on the wafer and complete the whole stacked loop structure. However, these metal lines and semiconductor devices result in severe surface topography of integrated circuits that leads to difficulty in subsequent deposition or pattern transfer processes. Therefore, both the protruding deposition layer and uneven surface profile of the wafer need to be removed by a planarization process.

Chemical-mechanical polishing (CMP) is the most commercially applied planarization technique. CMP is similar to that of mechanical polishing in its use of the "blade" principle, of which a polishing slurry with adequate chemical additives are supplied to react with the surface of the wafer and polish the uneven surface profile of the wafer to achieve planarization. In this planarization method, the wafer is typically mounted onto a carrier head, and the exposed surface of the wafer is placed against a rotating polishing pad. The carrier head provides a controllable load, i.e., pressure, on the wafer to push it against the polishing pad. Typically, the carrier head includes a flexible membrane interposed between the wafer and the carrier head, so that the pressurized membrane forces the wafer into contact with the polishing pad. In addition, the carrier head includes a retaining ring around the wafer to hold it beneath the carrier head. A gap between the retaining ring and the flexible membrane is usually found having a mass of slurry residues after a period of polishing time. These slurry residues may bring issues such as scratches on the wafer or decrease in carrier lifetime. Therefore, there is a need for a CMP apparatus that removes slurry residues from the gap in the wafer carrier.

SUMMARY OF INVENTION

It is therefore an object of the claimed invention to provide a wafer carrier gap washer to prevent scratches on wafers and increase the lifetime of the wafer carrier.

According to one embodiment of the claimed invention, the wafer carrier gap washer includes at least one wafer carrier head and at least one nozzle installed on a wafer load/unload mechanism. The wafer carrier head has a flexible membrane and a retaining ring for holding a wafer beneath the wafer carrier head during a CMP process. The nozzle sprays fluid toward a gap between the flexible membrane and the retaining ring so as to wash the gap and remove slurry residues produced in the CMP process.

It is an advantage of the claimed invention that the wafer load/unload mechanism used to loading wafer(s) to or unloading wafer(s) from a CMP apparatus is modified to be the wafer carrier gap washer. The nozzle added onto the wafer load/unload mechanism sprays fluid, including DI water and/or chemicals, to wash the gap. Since the positions of the nozzles can be adjusted to wash the gap, the slurry residues or other contaminants remained in the gap can be effectively removed by the fluid jetted from the nozzle.

These and other objects of the claimed invention will be apparent to those of ordinary skill in the art with reference to the following detailed description of the preferred embodiments illustrated in the various drawings.

DETAILED DESCRIPTION

Figure 1:
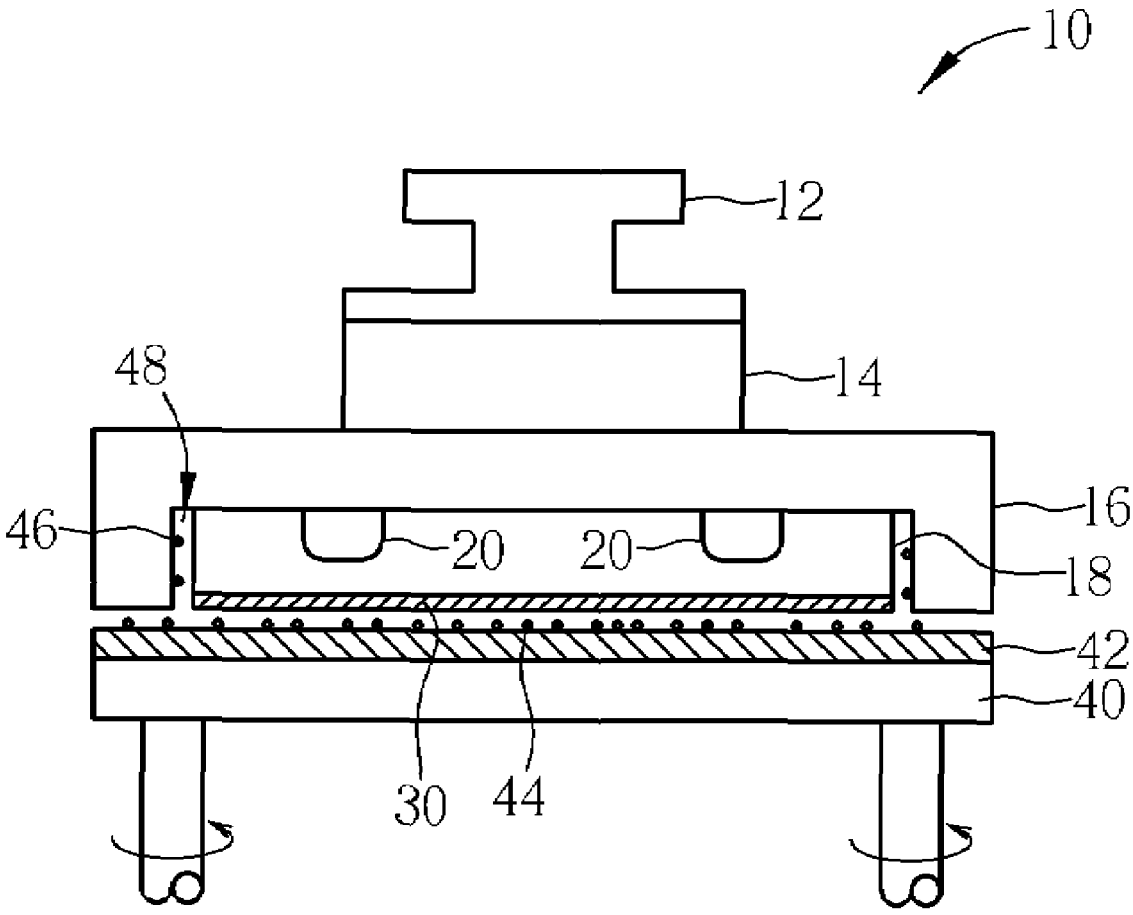
FIG. 1 is a schematic diagram of a wafer carrier head in a CMP apparatus according to the present invention.

Referring to FIG. 1, FIG. 1 is a schematic diagram of a wafer carrier head in a CMP apparatus according to the present invention. It is appreciated that only one wafer carrier head is illustrated for convenience, however, the CMP apparatus is allowed to have a plurality of wafer carrier heads according to the present invention. As shown in FIG. 1, a wafer carrier head 10 includes a control module 12, a support device 14 connecting the control module 12 to a retaining ring 16, a flexible membrane 18 connected to an inner surface of the retaining ring 16, and a plurality of chambers 20 positioned within the flexible membrane 18 and attached to the retaining ring 16. The control module 12 provides a force to press the support device 14 and the retaining ring 16 downward, so as to force a wafer 30 mounted to the flexible membrane 18 to contact with a polishing pad 42 positioned on a rotatable platen 40. In a better embodiment of the present invention, the support device 14 has a support assembly for holding the wafer carrier head 10, and the support assembly is covered by a bellows or a flexible tube. While the control module 12 provides a force on the support device 14, the cover of the support device 14 is lengthened or shortened to control the vertical position of the retaining ring 16. The chambers 20 are air bags used to control the pressure distribution within the flexible membrane 18. During a CMP process, the flexible membrane 18 is pressurized and extended to force the wafer 30 into contact with the polishing pad 42. In addition, a polishing slurry 44, including chemically-reactive agents and abrasive particles, is provided on a surface of the polishing pad 42 to assist in removing a target layer (not shown) formed on the wafer 30. A gap 48 between the flexible membrane 18 and the retaining ring 16 is about 2–3 mm in width, therefore a mass of contaminants, such as slurry residues 46, are usually found within the gap 48 after a period of polishing time.

Figure 2:
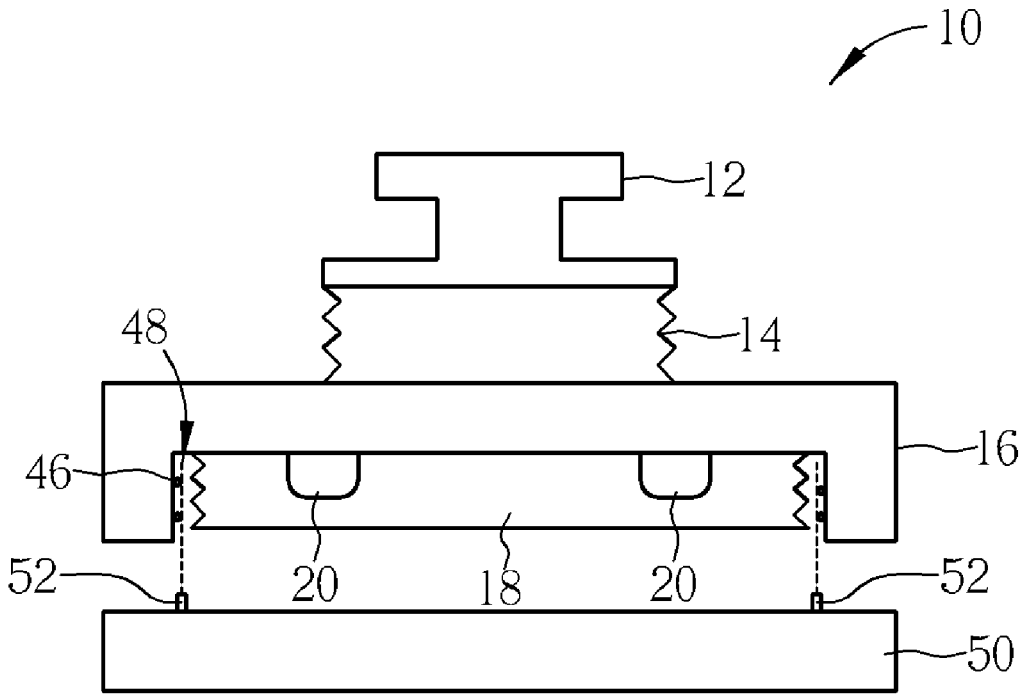
FIG. 2 is a schematic diagram of a gap washer for washing a wafer carrier head according to the present invention.

Referring to FIG. 2, FIG. 2 is a schematic diagram of a gap washer for washing a wafer carrier head according to the present invention. As shown in FIG. 2, a plurality of nozzles 52 are installed on a modified wafer load/unload mechanism 50. The modified wafer load/unload mechanism 50 can be any kind of wafer load/unload mechanisms with the nozzles 52 installed thereon. For example, the wafer load/unload mechanism 50 can be a robot that is used to loading wafer to be polished onto the wafer carrier head 10, unloading the polished wafer from the wafer carrier head 10, and transferring the polished wafer to a cleaning station (not shown) in the CMP apparatus. According to a better embodiment of the present invention, the wafer load/unload mechanism 50 is modified by adding the nozzles 52 on a surface thereof to face the wafer carrier head 10, and more specifically, by adding the nozzles 52 on the rim thereof to face the gap 48 between the flexible membrane 18 and the retaining ring 16. The nozzles 52 are connected to at least one fluid source to provide at least one cleaning fluid to wash the gap 48. After the wafer 30 is unloaded from the wafer carrier head 10, the nozzles 52 spray cleaning fluid toward the gap 48 to remove the slurry residues 46 out of the gap 48. The fluid can be DI water and/or chemicals to dissolve the slurry residues 46. To obtain better efficiency, the wafer carrier head 10 is kept wet idling with DI water and/or chemicals. The nozzles 52 can be controlled to spray different fluids at each of the nozzles 52, or spray the same fluid at all the nozzles 52. It is noticeable that the positions of the nozzles 52 should be adjusted to wash the gap 48, and not to affect the normal operation of the wafer load/unload mechanism 50 to load/unload wafer(s).

In another embodiment of the present invention, the nozzles 52 can be arranged in a ring to clean the gap 48 within the single wafer carrier head 10. In addition, the plurality of nozzles 52 can be replaced by a ring nozzle that is parallel to the gap 48 between the flexible membrane 18 and the retaining ring 16. In this case, the wafer carrier head 10 is optionally wet idling or stopped while the ring nozzle sprays fluid toward the gap 48. In another embodiment of the present invention, while the CMP apparatus has a plurality of wafer carrier heads 10, each of the gaps 48 in the wafer carrier heads 10 can be washed by a plurality of nozzles 52 arranged in a ring or by a ring nozzle, alternatively.

In contrast to the prior art, the present invention modifies the wafer load/unload mechanism as the wafer carrier gap washer. The modified wafer load/unload mechanism has at least one nozzle to spray fluid, including DI water and/or chemicals, to wash the gap and remove the slurry residues from the gap. Therefore, the issues such as scratches on the wafer or decrease in carrier lifetime can be prevented according to the present invention.

Those skilled in the art will readily observe that numerous modifications and alterations of the device and method may be made while utilizing the teachings of the invention. Accordingly, the above disclosure should be construed as limited only by the metes and bounds of the appended claims.

What is claimed is:

1. A wafer carrier gap washer in a CMP apparatus, comprising:

at least one wafer carrier head, the wafer carrier head comprising a flexible membrane and a retaining ring for holding a wafer beneath the wafer carrier head during a CMP process; and at least one nozzle installed on a surface of a wafer load/unload mechanism and being perpendicular to the wafer load/unload mechanism to face a gap between the flexible membrane and the retaining ring, the nozzle spraying fluid toward the gap so as to wash the gap and remove slurry residues produced in the CMP process.

2. The wafer carrier gap washer of claim 1, wherein the fluid comprises DI water and chemicals to dissolve the slurry residues.

3. The wafer carrier gap washer of claim 1, wherein the gap is 2–3 mm in width.

4. The wafer carrier gap washer of claim 1, wherein the wafer load/unload mechanism comprises a robot for transferring the wafer.

5. A wafer carrier gap washer, comprising:

at least one wafer carrier head for holding a wafer to be processed, the wafer carrier head comprising at least one gap;

a wafer load/unload mechanism for loading the wafer to be processed onto the wafer carrier head and unloading the processed wafer from the wafer carrier head; and a plurality of nozzles installed on a surface of the wafer load/unload mechanism and being perpendicular to the wafer load/unload mechanism to face the wafer carrier head and jet the fluid toward the gap in the wafer carrier head so as to wash contaminants out of the gap after unloading the wafer from the wafer carrier head.

6. The wafer carrier gap washer of claim 5, wherein the fluid comprises DI water and chemicals to dissolve the contaminants.

7. The wafer carrier gap washer of claim 5, wherein the gap is between a retaining ring and a flexible membrane of a CMP apparatus.

8. The wafer carrier gap washer of claim 5, wherein the gap is 2–3 mm in width.

9. The wafer carrier gap washer of claim 5, wherein the wafer load/unload mechanism comprises a robot for transferring the wafer.

10. The wafer carrier gap washer of claim 5, wherein each of the nozzles sprays different fluid from the others.

11. The wafer carrier gap washer of claim 5, wherein the nozzles spray the same fluid.

12. The wafer carrier gap washer of claim 5, wherein the nozzles are arranged in a ring.

13. A wafer carrier gap washer in a CMP apparatus, comprising:

at least one wafer carrier head, the wafer carrier head comprising a flexible membrane and a retaining ring for holding a wafer beneath the wafer carrier head during a CMP process; and at least one ring nozzle installed on a wafer load/unload mechanism and being perpendicular to the wafer load/unload mechanism, the ring nozzle spraying fluid toward a gap between the flexible membrane and the retaining ring so as to wash the gap and remove slurry residues produced in the CMP process.

14. The wafer carrier gap washer of claim 13, wherein the fluid comprises DI water and chemicals to dissolve the slurry residues.

15. The wafer carrier gap washer of claim 13, wherein the gap is 2–3 mm in width.

16. The wafer carrier gap washer of claim 13, wherein the wafer load/unload mechanism comprises a robot for transferring the wafer.

* * * * *